United States Patent [19]

Lautenschläger

[11] Patent Number: 5,058,238

[45] Date of Patent: Oct. 22, 1991

[54] CROSSLINK HINGE WITH CLOSING MECHANISM

[75] Inventor: Reinhard Lautenschläger, Reinheim, Fed. Rep. of Germany

[73] Assignee: Karl Lautenschlager GmbH & Co. KG, Reinheim, Fed. Rep. of Germany

[21] Appl. No.: 511,071

[22] Filed: Apr. 19, 1990

[30] Foreign Application Priority Data

Apr. 28, 1989 [DE] Fed. Rep. of Germany ..... 3914100

[51] Int. Cl.[5] ..... E05D 5/00

[52] U.S. Cl. ..... 16/278; 16/288; 16/291; 16/296; 16/341

[58] Field of Search ..... 16/278, 288, 294, 296, 16/321, 323, 341, 302, 304, 291

[56] References Cited

FOREIGN PATENT DOCUMENTS 2749288 11/1978 Fed. Rep. of Germany ..... 16/288

*Primary Examiner*—Robert L. Spruill
*Assistant Examiner*—Carmine Cuda

[57] ABSTRACT

A crosslink hinge for hanging a door on a cabinet has two crosslink arms attached in the middle in a scissors-like manner. One end of one of the crosslink arms is coupled directly to the cabinet-related part of the hinge, which can be fastened on a mounting plate to the cabinet, and one end of the other crosslink arm is coupled directly to the door-related part which is a cup which can be set in a mortise in the door, and at the other end they are coupled indirectly each by a link to the other part of the hinge. The crosslink arm that is directly pivoted at one end on the door-related hinge part is formed by two flanges disposed parallel to one another at a distance apart and joined together at least sectionwise by a web to form a channel shape. The hinge furthermore contains a closing mechanism urging it resiliently into the closed position. The closing mechanism has a movable thruster which is situated in the end portion of the crosslink arm, between the flanges and underneath the web thereof, and is resiliently biased toward the fulcrum point of the link coupling the crosslink arm to the cabinet wall-related hinge part. The thrusting surface of this thruster is in contact with a cam surface of a cam element formed on the link in the area where the link is pivoted on the crosslink arm. The cam surface is of such a shape in connection with the contacting surface of the thruster that a torque acting on the link in the closing direction is produced only as it nears the closed position of the hinge.

8 Claims, 3 Drawing Sheets

Fig. 4
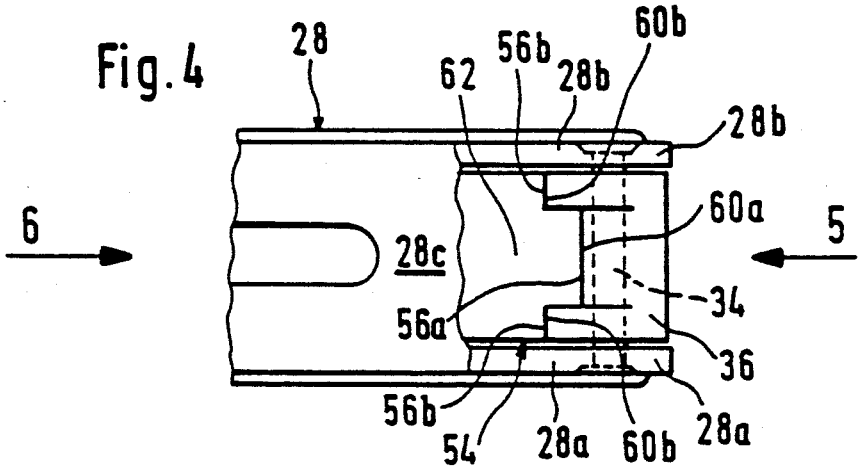
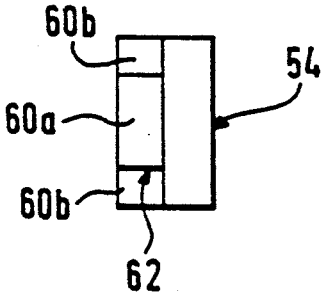
Fig. 5
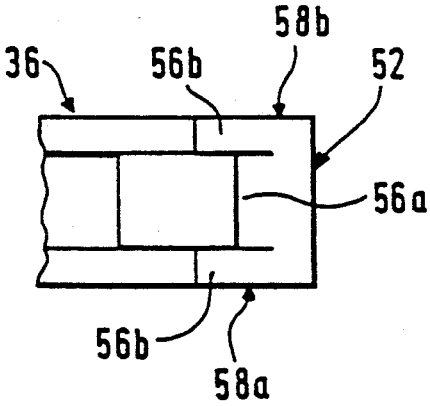
Fig. 6

CROSSLINK HINGE WITH CLOSING MECHANISM

BACKGROUND OF THE INVENTION

The invention relates to a crosslink hinge for hanging a door on a cabinet, having two crosslink arms joined pivotingly to one another in their central portion in a scissor-like manner and articulated at one end, one of them directly on the carcase-related part which can be fastened on a mounting plate to the carcase, and the other on the door-related hinge part configured as a cup which can be set in a mortise in the door, and at the other end articulated each indirectly by a link to the other hinge part, the crosslink arm directly articulated to the door-related hinge part being formed by two flanges disposed parallel at a distance apart and joined together at least section-wise by a web to form a profile arm of an inverted U-shaped cross section, and having a closing mechanism forcing the hinge resiliently to the close position.

Crosslink hinges of this kind are today used to an increasing extent by furniture manufacturers, because with the crosslink mechanism a linkage can be achieved which permits a door hung on a cabinet with such a hinge to be opened as much as 180 degrees, even if another door directly adjoins it, in the case of built-in cabinets, for example. Such crosslink hinges have already been provided with a closing mechanism which resiliently holds the door in the closed position (German Patent Disclosure Document 32 09 900). In this known crosslink hinge the closing mechanism is disposed within the crosslink arm coupled indirectly by a lever to the wall-related hinge part. It is formed by a two-armed cam lever mounted pivotingly on the hinge part. Its lever arm adjacent the door-related hinge part is biased resiliently to contact with the carcase-related hinge part, while the top side of the second lever arm of the cam lever pointing away from the door-related hinge part has a cam surface which cooperates with an actuating means in the form of a transverse pin provided on the double-walled link such that the cam lever's arm pointing toward the door-related hinge part is kept raised over most of the closing movement from the open position and does not come free of this transverse pin until the door is just about to reach the closed position. Consequently, the door end of the lever arm which then comes into contact with the pivot pin on which the crosslink hinge is coupled or with a roller disposed on the latter pulls the hinge to the fully closed position and holds it in this position. In the closed position of the hinge, the two-armed cam lever thus occupies the entire interior space between the two flanges of the crosslink arm directly coupled to the door-related hinge part, so that it is difficult to find additional room here for fasteners permitting the hinge to be adjusted.

It is the purpose of the invention to offer a crosslink hinge with a closing mechanism, in which the closing mechanism can be situated compactly within the hinge, but will reliably provide the closing torque for the closing even of heavy doors.

THE INVENTION

Setting out from a crosslink hinge of the kind described above, this purpose is accomplished in accordance with the invention, in that the closing mechanism has a displaceable thruster disposed between the flanges and under the web of the crosslink arm directly articulated to the door-related hinge part and biased resiliently toward the fulcrum point on the crosslink arm side of the link coupling this crosslink arm pivotingly to the supporting wall-related hinge part. The thrusting face of the thruster engages a cam surface formed on the link in the area where the link is articulated to the crosslink arm, the cam surface having such a shape in relation to the engaging surface of the thruster that a torque acting in the closing direction on the link develops only upon approaching the hinge-closed position. The closing mechanism is therefore located in the cabinet-interior end portion of the said crosslink arm and cooperates with the cam on the associated link, thus leaving the larger, door-end portion of the crosslink arm free.

In a preferred further development of the invention, the configuration is such that the cam track provided on the cam is divided in its width into a central cam section and two externally adjoining outer cam sections, one on each side of the middle cam section, and the thrusting surface of the thruster is divided in width into corresponding thrusting surface sections; that the middle cam section of the cam element has in side elevation an arcuate shape concentric with the pivot axis of the crosslink arm and is in engagement with the associated thrusting surface section during a first part of the turning movement of the hinge from the open position toward the closed position, and that the outer cam sections, which cooperate with the two associated outer thirsting surface sections during a second, succeeding portion of the turning movement to the fully closed final position, are formed on cam sections projecting toward the thruster bilaterally beyond the middle cam surface section. In this embodiment, as long as no closing or opening torque seeking to change the position of the hinge is produced, the middle section of the cam will cooperate with the associated middle thrusting surface section of the thruster, because this section of the cam is concentric with the coupling axis of the link and crosslink arm, and thus the direction of action of the spring bias exerted by the pusher on the cam surface passes through the pivot axis coupling the link to the crosslink arm. Not until the curves on the cam sections projecting on both sides from the cam mid-section are engaged by the associated sections of the thrusting surfaces is any leverage applied by the spring to the link to produce the desired closing torque.

In an advantageous further development of the invention, the configuration can then be made such that the thruster has, at a distance from the thrusting surface sections to the door, a middle section enlarged toward the mounting plate, in which a recess open in the end facing away from the thrusting surface is provided, in which at least one spring under compressive bias is disposed, whose end protruding from the open mouth of the recess thrusts against a pin held at a distance below the web in bores in the flanges of the crosslink arm.

The transverse pin supporting the spring or springs can at the same time reach under a projection in the mid-section of the thruster, extending toward the door-related hinge part and thus hold the thruster, at its end portion remote from the thrusting surface, in contact with the inside of the web. This pin therefore serves two functions, on the one hand by guiding the thruster for displacement at its end facing the door, and on the other hand by supporting the spring or springs.

The end of the thruster pointing into the interior of the carcase may be displaceably held against the inner face of the crosslink arm by a pin, by providing between the thruster face of the thruster and the enlarged middle section receiving the spring(s) a second pin held in bores in the flanges of the crosslink arm.

In transverse direction the displaceable holding of the thruster is accomplished by giving it a width corresponding approximately to the clear distance between the flanges of the crosslink arm, or a slightly smaller width, i.e. the flanges form lateral guides for the thruster.

The thruster itself is advantageously molded from a plastic material having suitable strength and anti-friction properties.

BRIEF DESCRIPTION OF THE DRAWINGS

The invention will be further explained in the following description of an embodiment in conjunction with the drawing wherein:

FIG. 4 is a top view of the cabinet-interior end section of the crosslink arm accommodating the closing mechanism, and a portion of the link pivotingly coupled to it, as seen in the direction of arrow 4 in FIG. 2, FIG. 5 is a view of the thruster of the closing mechanism, as seen in the direction of arrow 5 in FIG. 4, and FIG. 6 is a view of the cam element formed on the link and cooperating with the thruster, as seen in the direction of arrow 6 in FIG. 4.

Figure 1:
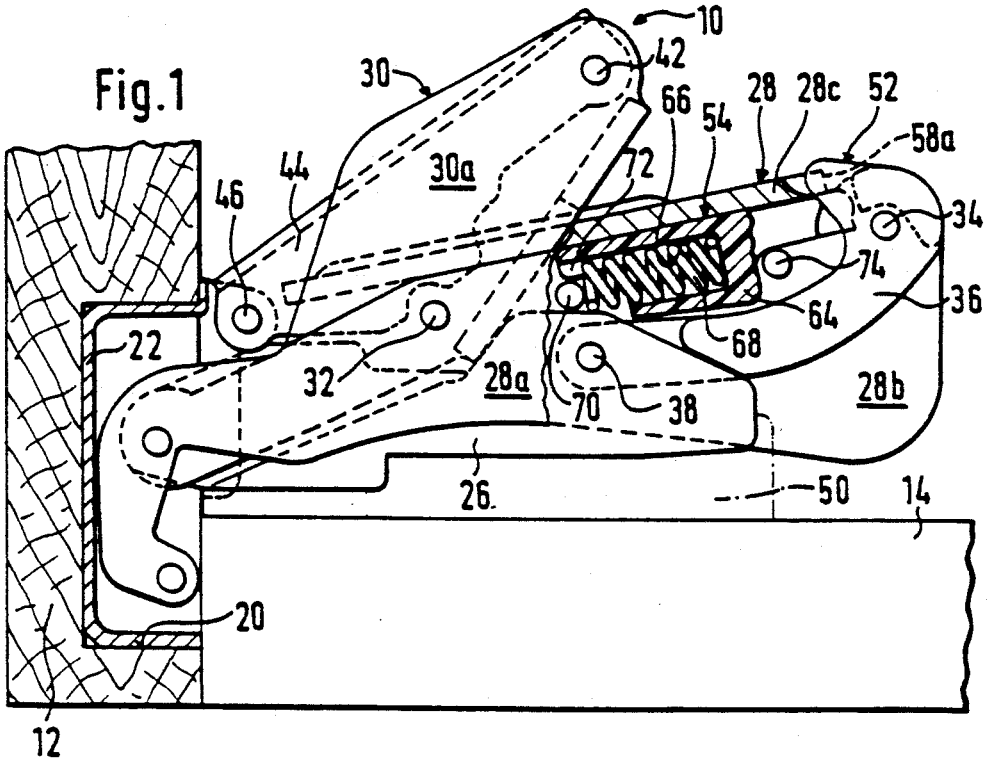
FIGS. 1, 2 and 3 are side views of a crosslink hinge in accordance with the invention in the closed position, in a partly open position, and in the fully open position on a corresponding door; one flange, facing the viewer, of the crosslink arm that contains the closing mechanism, is partly cut away.
Figure 2:
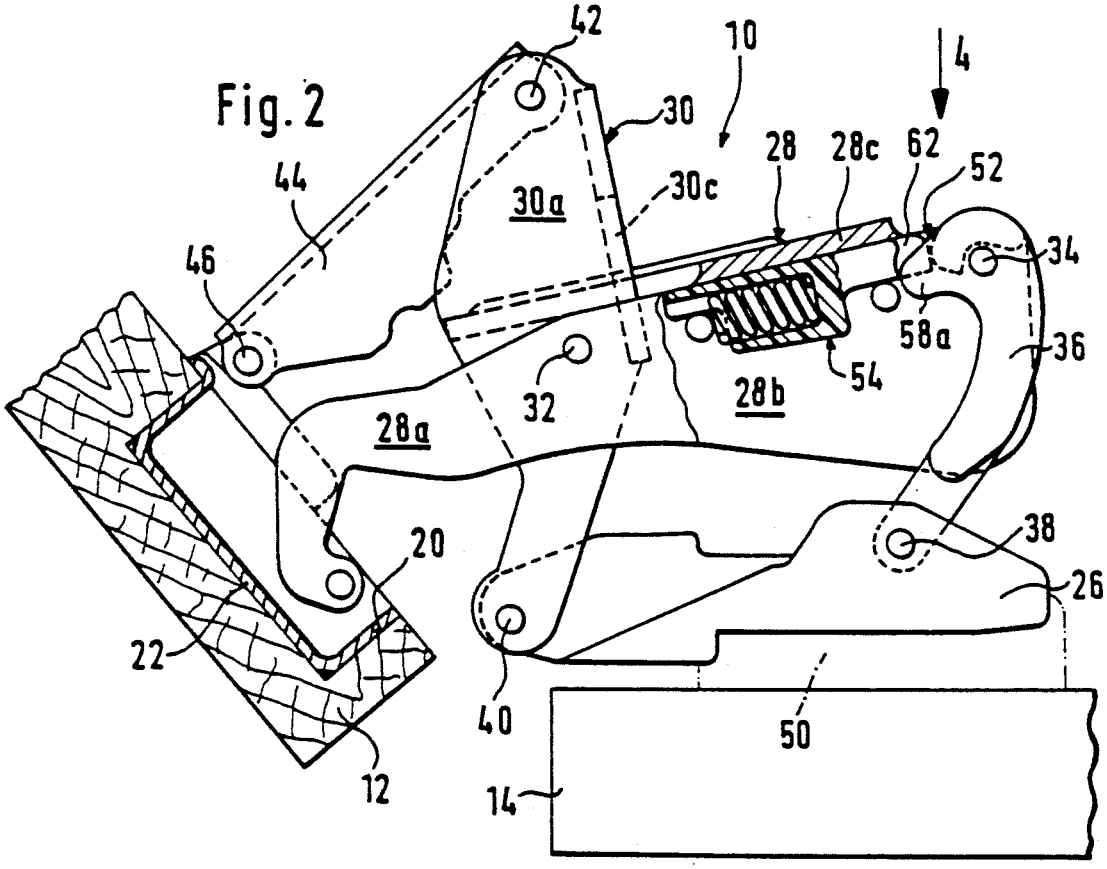
Figure 3:
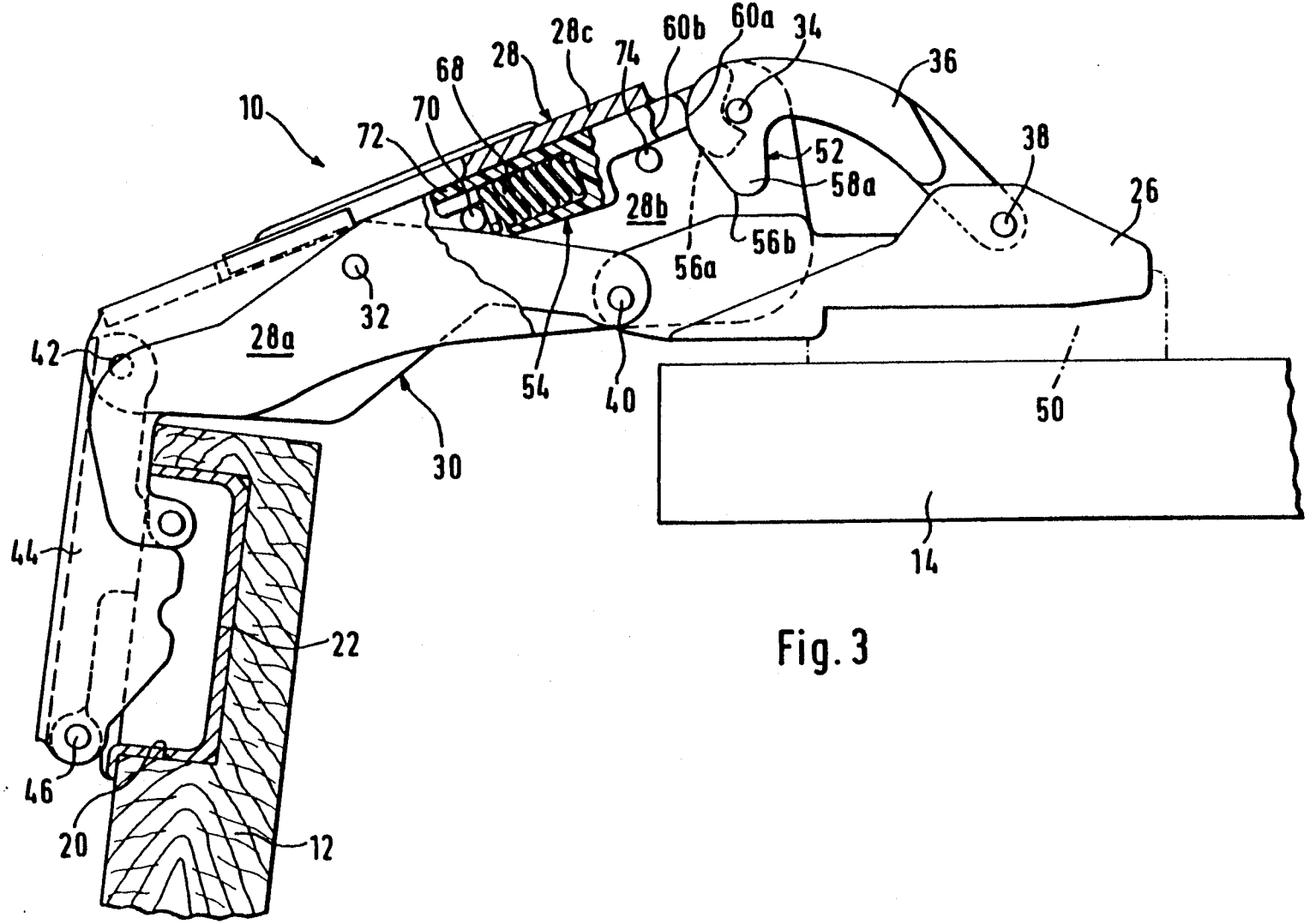

The hinge shown in FIGS. 1 to 3 and identified as a whole by 10, serves for hanging a door 12 on a wall 14 of a cabinet carcase, the door 12 resting against the front edge of the wall 14 when in the closed position (FIG. 1). The door-related hinge part configured as a cup 22 and set in a mortise 20 in the door 12, and the carcase-related hinge part fastened to the inside face of the wall 14, are coupled pivotingly to one another by a crosslink mechanism. This crosslink mechanism consists of two crosslink arms 28, 30, which are pivoted together in a scissors-like manner on a pivot pin 32. The crosslink arm 28 on the left in FIGS. 1 to 3 is directly pivoted within the cup 22, while its carcase end is pivoted on a pin 34 to a link 36 which in turn is pivoted on the cabinet-interior end of the carcase-related hinge part 26. The second crosslink arm 30 is directly pivoted at one end at 40 on the carcase-related hinge part, while its other end is pivoted at 42 to a link 44 the other end of which is pivoted at 46 in the cup 22. The basic construction of this crosslink mechanism in the manner described is known. The crosslink arms 28 and 30 are, in the case represented, sheet-steel stampings having two flanges **28*a*, 28*b*, and 30*a*, 30*b*, disposed parallel at a distance apart, but they are joined together by webs 28*c* and 30*c*, respectively, to form integral units. The carcase-related hinge part 26 is, in a conventional manner, adjustably mounted on a mounting plate 50 which is indicated only by broken lines and which can be mounted in the usual manner on the inside face of the wall 14** with screws or in any other manner.

The link 36 coupling the crosslink ar 28 at its end inside the cabinet indirectly to the wall-related hinge part 26 is, in the case represented, die-cast from metal, e.g., zinc alloy (Zamak). Thus it becomes possible to provide, on the end of this link which is coupled to the crosslink arm, an integrally formed cam 52 to cooperate with a thruster 54 disposed under spring bias between the flanges **28*a* and 28*b* and under the web 28*c* of the crosslink arm 28. This thruster 54 forms the closing mechanism which, when the door 12** hung on the cabinet nears the closed position, pushes the door to the fully closed position and holds it closed by spring bias.

The cam 52 does not have simply a single continuous curve but is divided into two sections associated with two successive parts of the turning movement of the hinge 10, i.e., sections which go into action successively. The cam section **56*a*, which is the first to act as the closing movement begins after an opening movement, is disposed centrally between two outer cam sections 56*b* which go into action as the closing movement continues, but both of these cam sections have the same curvature and thus the same closing characteristic, and therefore, as far as their operation is concerned, they can be considered as one cam section of twice the width of the single cam section 56*b*. The cam section 56*a* formed on cam 52 has an arcuate shape concentric with the central axis of the pivot pin 34, i.e., as seen in a side view (FIGS. 1 to 3). The cam sections 56*b* which become active afterward, i.e., the cam sections turning away at a tangent from section 56*a*, are formed on two cam lobes 58*a*, 58*b*, which project straddlingly on both sides of cam section 56*a***.

To correspond to the division of the surface of cam 52, the free end of the finger 62 of the thruster 54 is divided into a center section **60*a* cooperating with cam section 56*a*, and two adjoining outer sections 60*b* cooperating with cam sections 56*b*. The central section 60*a* is formed on the outermost end of finger 62 extending toward the cam 52, and its width is substantially equal to the width of the cam section 56*a*, and therefore it can be straddled by the cam sections 58*a*, 58*b*, of cam 52. The outer sections 60*b* on the other hand are set back from the center section 60*a***.

The butt 64 of the thruster is wider than the finger 62 and contains a recess 66 into which a spring 68 is inserted, or two springs mounted parallel, side by side. This spring 68 thrusts at one end against the bottom of the recess 66 and at the other end against a transverse pin 70 held between the flanges **28*b* of the crosslink arm 28, and the energy stored in the spring or springs urges the thruster 54 against the cam 52. The pin 70 at the same time supports a projection 72 extending toward the end of the crosslink arm 38 that is journaled in the cup 22, thus holding the thruster 54 in contact with the inside of the web 28*c* in this area. At the free end of the finger 62 the thruster is supported by an additional pin 74 held between the flanges 28*a*, 28*b*, of the crosslink arm 28 and thus held in contact with the web 28*c***. The pusher itself is injection molded from a plastic of appropriate strength and low surface friction.

The interaction of the cam 52 at the upper end of the link 36 with the thruster 54 can be seen in FIGS. 1 to 3 showing different positions of the hinge. In FIG. 1 it can be seen that, when the hinge is closed the outer two ends **60*b* of the thruster 54 attack the cam sections 56*b* of the cam 52 such that in the direction of action of the spring bias a comparatively long lever arm develops with respect to the axis of the pin 34, causing a closing torque acting clockwise on the link 36. In FIG. 2 is shown the partially open position in which the thruster ends 60*b* are just coming free of the associated cam sections 56b on the cam, and instead the thruster end 60a now comes in contact with the center cam section 56a. Since cam section 56a is concentric with the central axis of pin 34, from then on until the hinge is fully open as shown in FIG. 3 no closing or opening torque will be produced between the crosslink arm 28 and the link 36. By varying the shape of cam section 56a** such that the spring bias transmitted by the thruster acts with leverage on the central axis of the pivot pin, a different characteristic could, of course, be achieved, as for example a characteristic by which, when the crosslink hinge nears its fully open position, the spring bias of the closing mechanism will carry it to the fully open position and hold it resiliently in this fully open position.

I claim:

1. A crosslink hinge for hanging a door on a carcase of a piece of furniture, comprising: a door-related hinge part configured as a cup to be set in a mortise in the door, and a carcase-related hinge part to be fastened on a mounting plate on the piece of furniture, said crosslink hinge having a first and a second crosslink arm, a first pivot joining said arms to each other at central portions thereof, said first arm having a first end articulated directly to said cup and a second end articulated indirectly to said carcase-related hinge part by a first link, a second pivot connecting said second end to said first link, said second arm having a first end articulated directly to said carcase-related hinge part and having a second end articulated indirectly to said cup via a second link, said first cross link arm being formed by two flanges disposed parallel to each other in spaced relationship and joined to each other at least in sections b a web so as to form a profile arm of an inverted U-shaped cross section, a closing mechanism for forcing said hinge to a closed position, said closing mechanism including a displaceable thruster disposed between the flanges under the web, and spring means for resiliently biasing said thruster toward said second pivot, said thruster having a thruster surface engaging a cam face of a cam element formed on said first link at said second pivot, said cam face having such a shape in relation to the thruster surface of said thruster that a torque acting in closing direction on said first link develops only upon approaching the closed position, wherein the cam face provided on said cam element is divided in its width into a central cam section and two externally adjoining outer cam sections, one on each side of the central cam section, the thruster surface of the thruster being divided in width into corresponding thruster surface sections, said central cam section of the cam element having in side elevation an arcuate shape concentric with respect to said second pivot and being in engagement with the associated thruster surface section during a first section of the turning movement of the hinge from an open position toward the closed position, the outer cam sections cooperating with the two associated thruster surface sections during a second, succeeding section of the turning movement to the closed position, and being formed on cam sections projecting on both sides beyond the central cam section toward said thruster.

2. A crosslink hinge according to claim 1, wherein said thruster has at a distance from the thruster surface sections toward said door-related hinge part a middle section enlarged toward the mounting plate, a recess in said middle section, open at an end facing away from the thruster surface, at least one spring in said recess under compressive bias, said at least one spring having an end protruding from the open end of the recess and thrusting against a pin held at a distance below the web in bores in the flanges of said first crosslink arm.

3. A crosslink hinge according to claim 2, wherein said transverse pin reaches under a projection in said middle section of said thruster, extending toward the door-related hinge part and holds the thruster in contact with the inside of the web.

4. A crosslink hinge according to claim 3, wherein in a section between the truster surface sections and the middle section said thruster is held with its thruster surface end in contact with the inside of the web by a second pin held in bores in the flanges of said first crosslink arm.

5. A crosslink hinge according to claim 2, wherein in a section between the thruster surface sections and the middle section said thruster is held with its thruster surface end in contact with the inside of the web by a second pin held in bores in the flanges of said first crosslink arm.

6. A crosslink hinge according to claim 2, wherein said at least one spring is a helical spring under compressive bias.

7. A crosslink hinge according to claim 1, wherein said thruster has a width corresponding approximately to, or being slightly smaller than, the clear internal distance between the flanges of said first crosslink arm.

8. A crosslink hinge according to claim 1, wherein said thruster is an injection-molded plastic part.

* * * * *